United States Patent [19]

DiRoss

[11] 4,418,658

[45] Dec. 6, 1983

[54] ENGINE VALVE

[76] Inventor: James DiRoss, 8002 E. Hubbell St., Scottsdale, Ariz. 85257

[21] Appl. No.: 420,015

[22] Filed: Sep. 20, 1982

Related U.S. Application Data

[63] Continuation-in-part of Ser. No. 166,142, Jul. 7, 1980, abandoned.

[51] Int. Cl.[3] ..... F01L 7/06

[52] U.S. Cl. ..... 123/80 D; 123/41.4; 123/190 A; 123/190 D; 123/190 DL

[58] Field of Search ..... 123/80 R, 80 BA, 80 D, 123/41.4, 190 R, 190 A, 190 BD, 190 D, 190 DL, 59 AD

[56] References Cited

U.S. PATENT DOCUMENTS

| | | | |
|---|---|---|---|
| 1,068,724 | 7/1913 | Ybarra | 123/190 D |
| 1,314,137 | 8/1919 | Gamble | 123/190 D |
| 1,726,299 | 8/1929 | Heurich et al. | 123/190 DL |
| 1,878,535 | 9/1932 | Pasholk | 123/190 DL |

FOREIGN PATENT DOCUMENTS

| | | | |
|---|---|---|---|
| 1121405 | 1/1962 | Fed. Rep. of Germany | 123/190 D |

*Primary Examiner*—Craig R. Feinberg
*Assistant Examiner*—W. R. Wolfe
*Attorney, Agent, or Firm*—Warren F. B. Lindsley

[57] ABSTRACT

A rotary valve for internal combustion engines, compressors and the like wherein its valve plate engages directly with the cylinder block and which is lubricated by oil passageways in the valve plate or wear surface of the cylinder block.

4 Claims, 15 Drawing Figures

ENGINE VALVE

BACKGROUND OF THE INVENTION

This application is a continuation in part of U.S. patent application, Ser. No. 166,142, filed July 7, 1980 and entitled Engine Valve, now abandoned.

This invention relates to engines and more particularly to the intake and exhaust valves therefor.

Internal combustion engines have a tremendous task to perform and under the very best conditions, they are not all that could be desired. The conditions under which their valves operate would seem to impose an impossible task upon them, but they have been developed to a point where they are fairly efficient. A great amount of ingenuity has been expended upon sleeve valves, rotary valves, slide valves and poppet valves with the poppet valve, despite all its shortcomings, being used almost universally.

Poppet valves are noisy and difficult to cool but they are simple and provide an efficient seal under operating conditions.

These operating conditions are brutal. The valves are in the combustion chamber and are exposed to the burning gas but are not surrounded with cooling water as is the combustion chamber. Neither are they cooled by oil as is the piston. The explosion temperature within an engine combustion chamber may momentarily approach 5000 degrees Fahrenheit and the exhaust valve must then open and permit these hot gases to go between the head valve and the cylinder block at high velocity.

It may be readily seen that the exhaust valve head may attain a temperature of 1000 degrees Fahrenheit or more under these conditions.

Since the valve cannot readily be cooled directly by the cooling water in the engine and the only cooling comes from contact with the valve guides and with the cylinder block during the short period of time it is in contact with the valve seat, valve cooling becomes a problem.

The popular conception that solid exhaust valves are cooled primarily by conduction down the stem is not true. The primary heat flow path is from the face of the valve. In fact, it is believed that over half of the total heat absorbed by the valve leaves through its face.

From the foregoing, it is realized that anything that reduces the area of contact between the valve and the cylinder head or block will hamper the escape of heat from the valve.

One of the most important factors effecting valve temperature is that of valve lash or toppet clearance. Insufficient clearance will result in the valves contacting the seats for a shorter time and consequently operating at a higher temperature. Excessive clearance will result in noisy operation and loss of power.

It should be noted that the heat flows from the valve stem of the poppet valve to the valve guide and from the guide to the block. Here again, the heat transfer would be facilitated if the valve stem was in direct and intimate contact with the block.

Although rotary valves are known and have desirable heat transfer characteristics, they have not been well received to date. This valve consists of a revolving shaft or plate having a through opening which will become aligned with openings at each side when the rotor is properly positioned. One disadvantage of the valve, however, is that it is only fully opened during a fractional part of the time between start and finish of a valve opening operation.

This type of valve has been directly attached to one end of the crankshaft or separately geared therefrom and rotates against a wear plate which in turn is secured to the crankcase. When the valve is open or closed, it makes a tight seal against the wear plate.

DESCRIPTION OF THE PRIOR ART

Although the poppet, rotary and sleeve valves have been known and utilized in various forms of internal combustion engines and compressors, none have satisfactorily solved the heat problem. With the rotary valve being more adaptable to rapid heat transfer to the block of the engine, this valve needs to be improved to function more satisfactorily under high speed conditions to compete with the present day poppet valve.

U.S. Pat. No. 1,230,286 discloses an internal combustion engine having a dome-shaped slot configuration wherein the rotary valve for controlling intake and exhaust parts associated therewith are mounted inside of the dome-shaped configuration along the inside surface thereof.

U.S. Pat. No. 1,066,160 discloses an internal combustion engine employing a circular valve which has teeth along its outer periphery.

U.S. Pat. No. 2,288,774 discloses two rotary valves controlling intake and exhaust ports on an outside surface of a dome-shaped head with means for rotating the valves.

U.S. Pat. No. 2,874,686 discloses a rotating valve for internal combustion engines wherein the valve is mounted inside of the cylinder of the block exposed to the high temperatures of the combustion chamber.

The Austria Pat. No. 165,223 discloses a rotary valve actuated by teeth arranged around its periphery.

The German Pat. No. 911,791 discloses a dome-shaped configuration utilizing a concave valve with teeth around its periphery.

SUMMARY OF THE INVENTION

In accordance with the invention claimed, a new and improved rotary valve is disclosed for 2 and 4 stroke internal combustion engines as well as diesel and compressor use.

It is, therefore, one object of this invention to provide a new and improved rotary valve.

Another object of this invention is to provide a new and improved rotary valve employing teeth around the periphery of the valve for actuation thereof.

A further object of this invention is to provide new and improved rotary valves cooled on both sides thereof.

A still further object of this invention is to provide a rotary valve which operates on the outer periphery of the crankcase thus avoiding the use of a wear plate.

A still further object of this invention is to provide a dual purpose single plate rotary valve which functions to control the input and exhaust ports of an engine.

A still further object of this invention is to provide a rotary valve having one or more oil passages across the face of the associated portion of the cylinder block and/or the face of the rotary plate.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
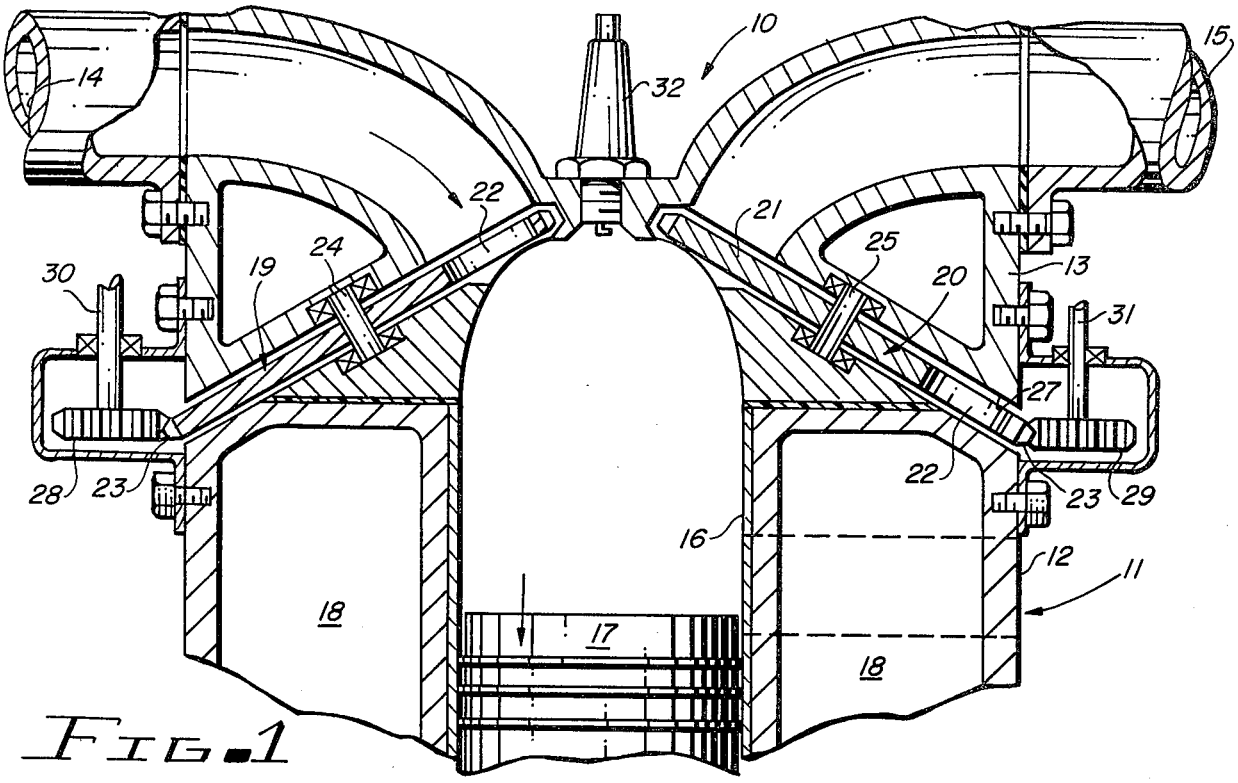
FIG. 1 is a cross-sectional view partly in elevation of a cylinder block casting for an overhead valve design for a small gasoline engine and embodying the invention.
Figure 2:
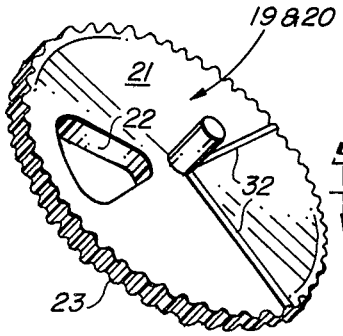
FIG. 2 is a perspective view of one of the rotary valves shown in FIG. 1.

Referring more particularly to the drawing by characters of reference, FIGS. 1 and 2 disclose an overhead valve design embodied in a cylinder block casing. As shown, the engine 10 comprises a cylinder block 11 which may comprise a first portion 12 having suitably attached thereto a second portion 13. The block whether a single or dual part configuration, defines an inlet port 14, an exhaust port 15 and a cylinder 16 in which is reciprocally mounted a piston 17. The block, as shown, is cooled by water flowing through the cooling chamber 18 formed around cylinder 16 in the usual manner.

FIG. 1 illustrates only one cylinder of the basic automobile engine which normally is a four cycle, water-cooled, popper valve gasoline engine. However, in this instance, the poppet valves have been replaced by the claimed rotary circular valves 19 and 20.

These rotary valves each comprise a flat plate 21 having a valve port 22 and a rack of gear teeth 23 arranged around their peripheries. These valves are rotary mounted on shafts 24 and 25 suitably journaled in slots 26 and 27 formed between portions 12 and 13 of the cylinder block 11 in meshing arrangement with drive gears 28 and 29. These drive gears may be connected through shafts 30 and 31, respectively, to the crankshaft of the engine (not shown) or any other suitable driving means. A suitable spark plug 32 is mounted in the head of the cylinder block between the intake and exhaust ports for fuel injection purposes.

The rotary valves 19 and 20 operate in the same manner as poppet valves in a four-stroke engine wherein rotary valve 19 is open and rotary valve 20 is closed on the intake stroke with the piston drawing fuel and air mixture into cylinder 16. On the compression stroke, both rotary valves are in their closed position. The rising piston in cylinder 16 compresses the fuel mixture.

At the upper limit of piston movement with both rotary valves closed, the mixture is ignited by spark plug 32 and the explosion forces the piston downward on the power stroke.

On the exhaust stroke, the exhaust rotary valve 20 is open and the rising piston pushes the sent gases from the cylinder.

In a four-cycle engine operating at 2000 r.p.m., any one cylinder will fire 1000 times in that minute and every time the cylinder fires, the exhaust valve must open to let the burned gases out. With poppet valves, the valve must lift off of its seat 1000 times each minute. Thus, it will not remain in contact with the cylinder block long enough at any one time for much of the heat to flow out of it. With rotary valves, however, the valve plate 21 is always in contact with the cylinder block and conducts heat away from it to the cylinder block continuously. This same condition applies to the inlet valve 14.

In order to further cool and lubricate the valves, the flat face of the valves 19 and 20, may be provided with oil passageways 33. These passageways are lubricated by fuel as the valve plate relates at various points in the four-stroke cycle of operation or by a separate oiling system designed for this purpose.

It should be noted that the valve plates 21 in FIG. 1 are each mounted on the tapered dome of the cylinder head which for purposes of manufacture and assembly, may be formed on the top of portion 12 of the cylinder block. These plates are shown as sliding directly over the flattened outer periphery of portion 11 without the benefit of a wear plate or biasing spring as used in the prior art. If a wear plate or biasing spring is needed, it could be added to the plate assembly in the manner used in the prior art.

Figure 3:
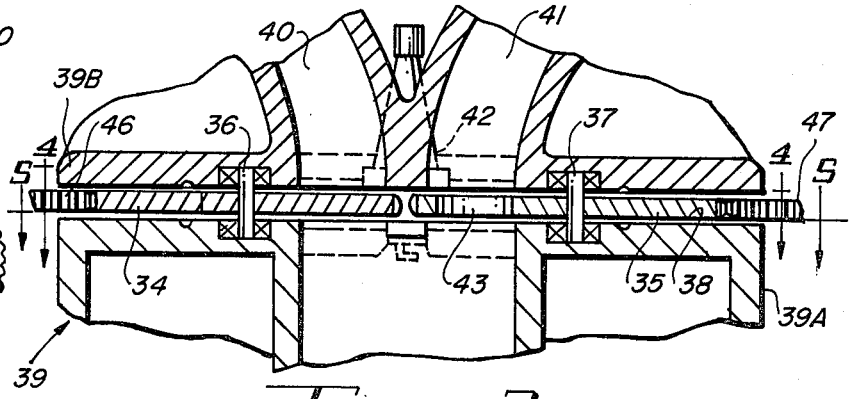
FIG. 3 is a partial cross-sectional view of a modification of the overhead valve design shown in FIG. 1.
Figure 4:
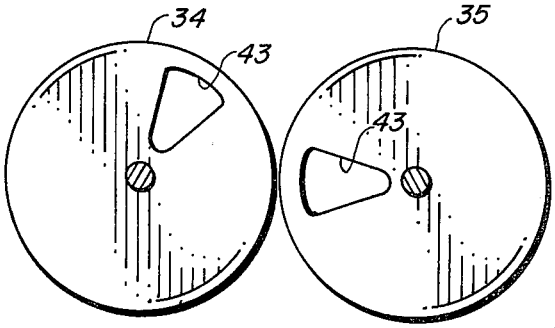
FIG. 4 is a cross-sectional view of FIG. 3 taken along line 4—4.
Figure 5:
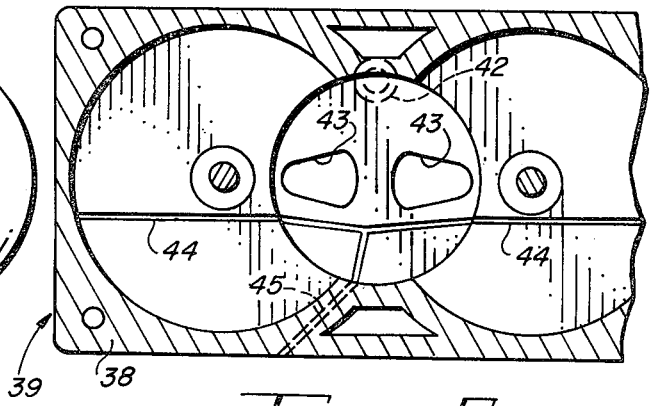
FIG. 5 is a cross-sectional view of FIG. 3 taken along the line 5—5.

FIGS. 3–5 disclose a modification of the structure shown in FIGS. 1 and 2 wherein a pair of circular valves 34 and 35 are rotatably mounted on shafts 36 and 37 on the flat top 38 of a cylinder block 39 comprising two portions 39A and 39B. Entrance and exhaust ports 40 and 41 extend outwardly of the top of the cylinder block with a spark plug 42 mounted adjacent thereto as shown. Each valve is provided with a port 43 for entrance and exhaust purposes as described above for the structure shown in FIG. 1. Oil passageways 44 may be provided in the surfaces of the valves but are shown as being formed in the cylinder block adjacent the surfaces of the valves for lubricating purposes either from and by the fuel stream or from another oiling means through a passageway 45.

Figure 6:
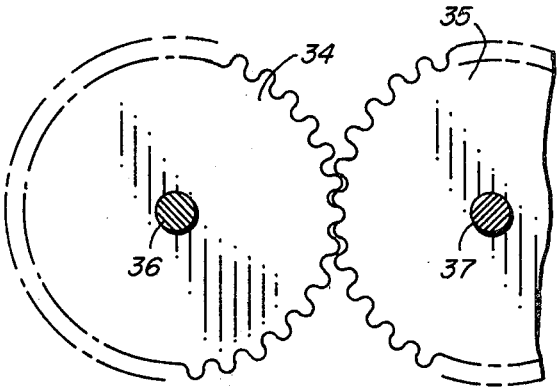
FIG. 6 is a plan view of a pair of meshing rotary valves.

The valves 34 and 35 may be provided with teeth around their periphery individually driven by suitable drive gears 46 and 47, as shown in FIG. 3, or the gears may mesh as shown in FIG. 6 with only one of the two rotary valves driven by a drive gear such as either of gears 46 and 47.

Figure 7:
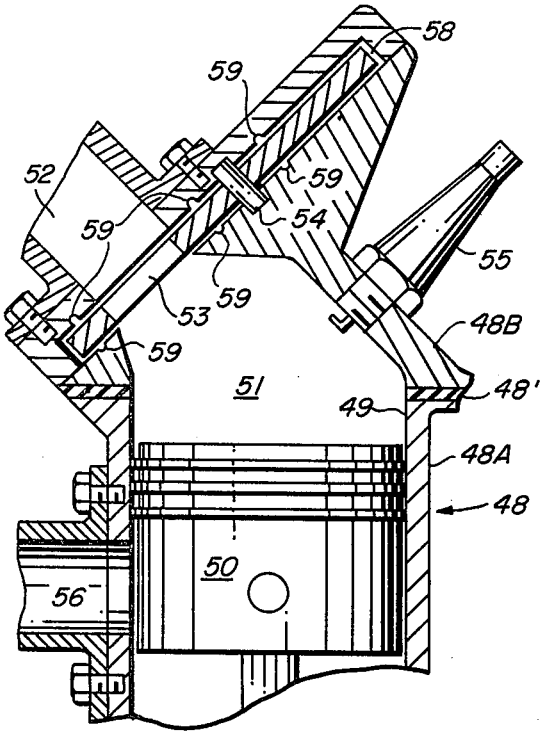
FIG. 7 is a cross-sectional view partly in elevation of a modification of the crankcases shown in FIGS. 1 and 3 employing the claimed rotary valve.

FIG. 7 illustrates a cylinder block which could be used for gasoline or diesel use. As shown, the cylinder blocks 48 which may be formed in two portions 48A and 48B, defines a cylinder 49, within which is reciprocally mounted a piston 50. The cylinder defines at one end thereof a combustion chamber 51. An input port 52 forms a fuel inlet which is controlled by a rotary circular valve 53. This valve is mounted on a shaft 54 for rotary movement by a suitable actuating means not shown. A spark plug or glow plug 55, depending on the type of engine used, is mounted on the cylinder block and extends into the combustion chamber as shown. An exhaust port 56 passes the burned gases to atmosphere in the usual manner. As shown, the supporting surfaces of the slot 58 provided for housing the rotary valve is provided with lubricating oil passageways 59 for the rotary valve.

Figure 9:
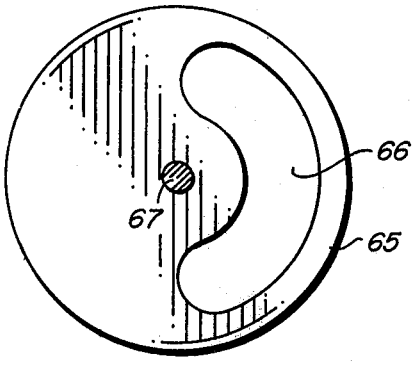
FIG. 9 is a cross-sectional view of FIG. 8 taken along the line 9—9.
Figure 8:
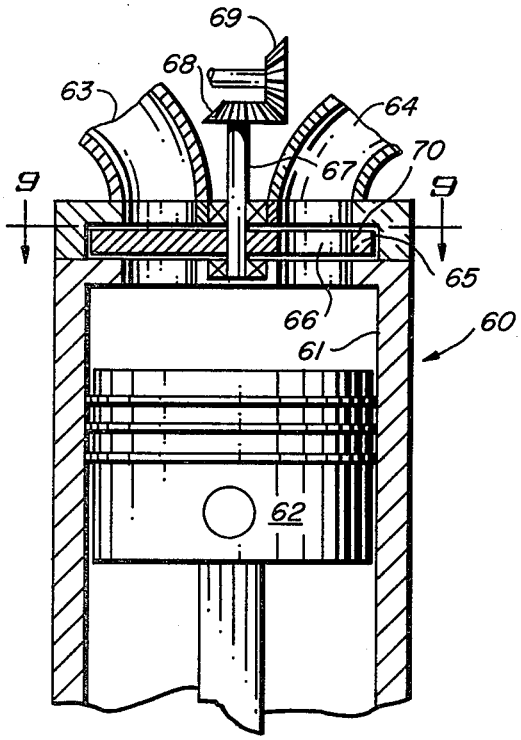
FIG. 8 is a cross-sectional view partly in elevation of a refrigeration or compressor embodiment of the invention.

FIGS. 8 and 9 disclose a cylinder block 60 for an air compressor. The block defines a cylinder 61 in which is reciprocally mounted a piston 62. At the top end of the cylinder is arranged input and output ports 63 and 64, respectively. These ports are controlled by a rotary circular valve 65 having an elongated arcuate port 66. The valve is mounted on a shaft 67, the free end of which is provided with a driven gear 69. As shown, the valve 65 rotates within a slot 70 formed in the cylinder block 60.

Figure 10:
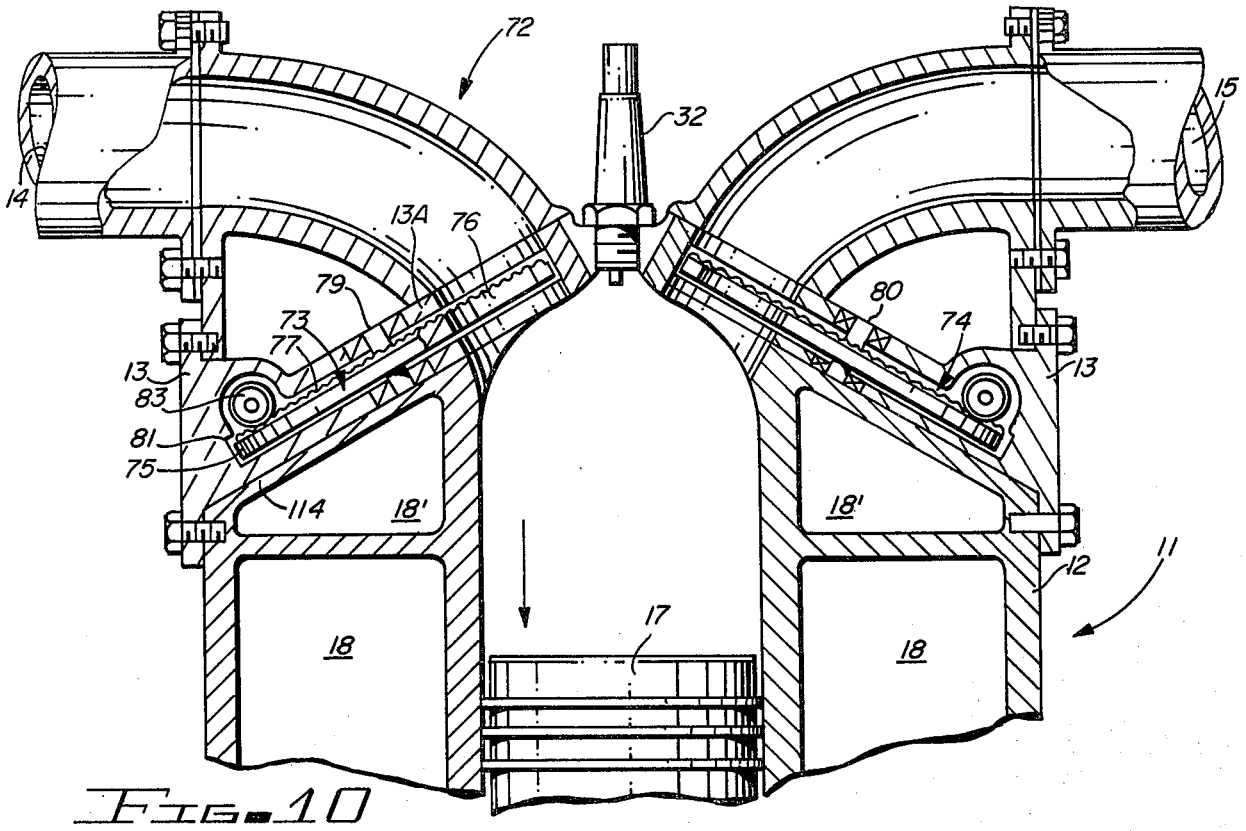
FIG. 10 discloses a cross-sectional view of a further modification of a cylinder block casting for an overhead valve design wherein the valve is cooled from both sides thereof and the valve is rotated by teeth on its top surface thereof.
Figure 11:
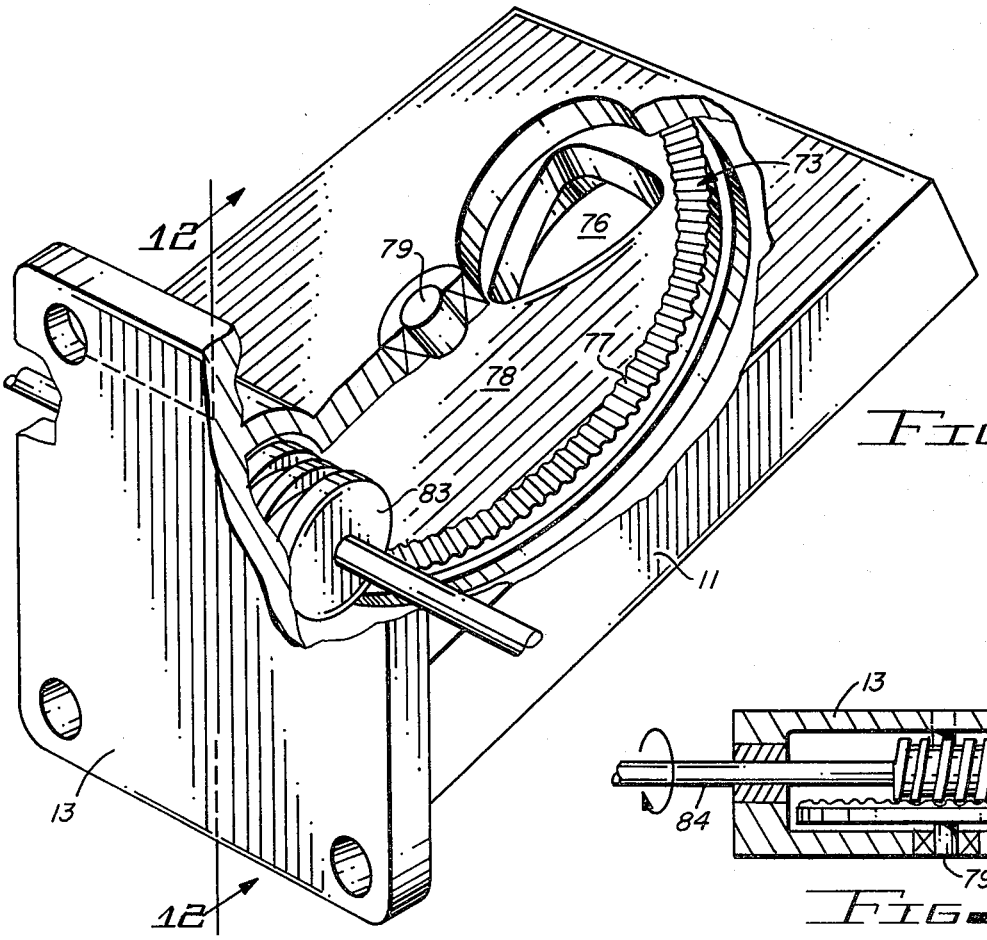
FIG. 11 is an enlarged partial view of FIG. 10 with parts broken away to show the valve driving mechanism.
Figure 12:
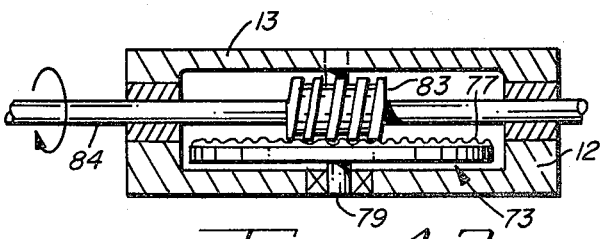
FIG. 12 is a cross-sectional view of FIG. 11 taken along the line 12—12.

FIGS. 10–12 disclose a further modification of the overhead valve configuration shown in FIGS. 1 and 2 wherein like parts of engine 72 are given the same reference characters as used in FIG. 1. Engine 72 differs in two important areas from engine 10, the first difference being the forming of an additional cooling chamber 18' which extends over more than one-half of the inner flattened periphery of portion 11A of the cylinder block 11, the outer surface of which forms the seat for rotary valve 73 and 74. The second difference being the rotary valves 73 and 74.

Valves 73 and 74 each comprise a flat plate 75 having a valve port which may be round or oblong-shaped, as desired, with the opening in the engine block being of like or different configuration and a rack of gear teeth 77 arranged on or in its upper surface 78 of the valve near its peripheral edge. These valves are rotary mounted on shafts 79 and 80 suitably journaled in slots 81 and 82, formed between portions 12 and 13 of the cylinder block 11 with teeth 77 in meshing arrangements with drive gears 83. Drive gears 83 may be connected through shafts 84 to the crank shaft of the engine (not shown) or any other suitable driving means.

Rotary valves 73 and 74 operate in the same manner as valves 19 and 20 of FIGS. 1 and 2 except that these valves are provided with the rack of teeth on their top surfaces near, but not on, their peripheral edge.

In order to further cool and lubricate the valves, they may be provided on their upper surfaces with oil passageways similar to passageways 33, shown in FIG. 2, or similar oil passages in the flat seating surface 11A of cylinder block 11 and/or in the coplanar cooperating surface 13A of second portion of cylinder block 11.

Thus, engine 72 differs from engine 10 of FIG. 1 and the prior art by providing further cooling areas for the valve which makes it possible to raise the compression ratio of the engine much higher than heretofore possible without the risk of pre-ignition. With a much higher compression ratio, greater fuel efficiency is accomplished.

Figure 13:
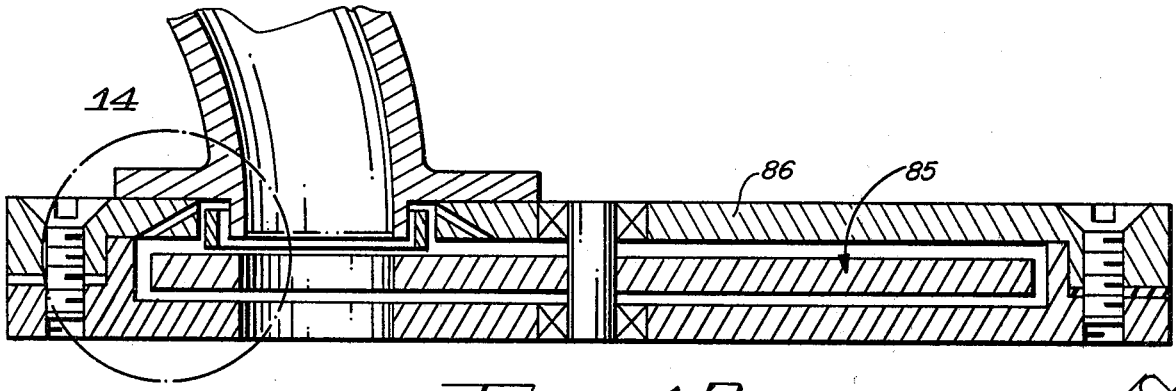
FIG. 13 is a partial cross-sectional view of a further modification of the valving mechanisms shown in FIGS. 1–12 illustrating a pressure equalizing means for the valve.
Figure 14:
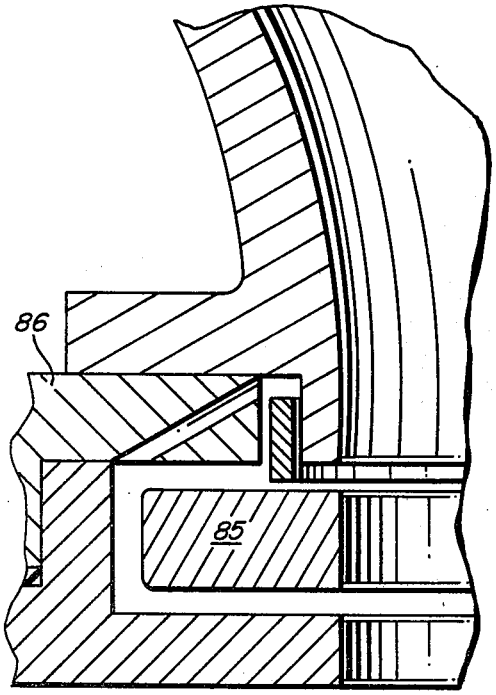
FIG. 14 is an enlarged view of the circled area of FIG. 13.

FIGS. 13 and 14 disclose a rotary valve 85, similar to valves 73 and 74, journaled within a unitary housing 86 which may be bolted to the top of cylinder block 11 in a suitable manner by bolts 87. The valve is designed to have equal pressure on both sides thereof for ease in operation. The valve may be driven by a drive-gear meshing with teeth on its top surface as shown in FIGS. 10–12 or around its periphery as shown in FIG. 1. If desired, the housing 86 may be formed of bronze for good heat conduction and lubricity and the valve 85 formed of alloy-bonded carbide for high strength, excellent lubricity and heat resistance.

Figure 15:
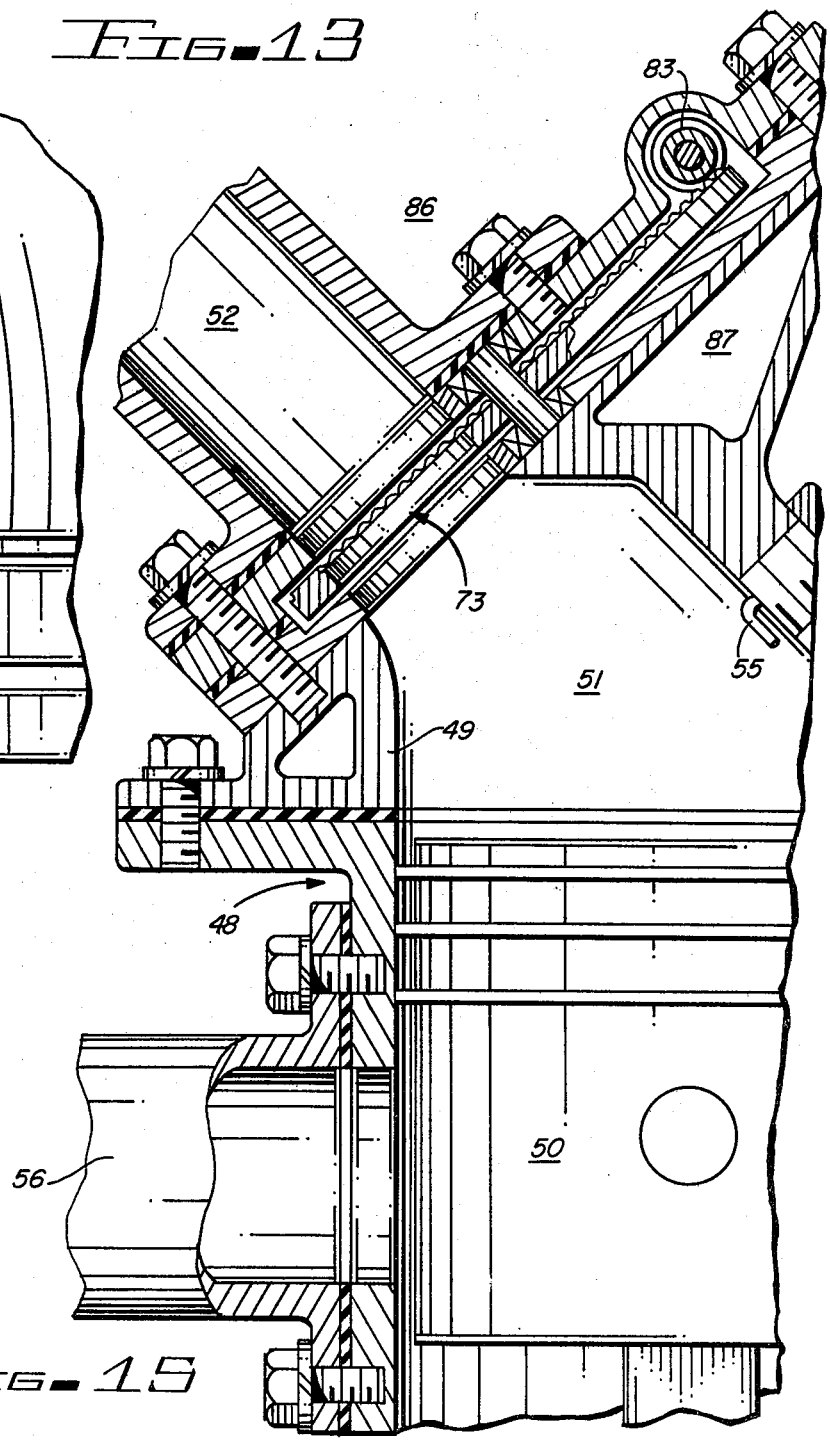
FIG. 15 is a still further modification of the crankcase shown in FIG. 7 employing the valving mechanism of FIGS. 10–12.

FIG. 15 discloses a modification of the structure shown in FIG. 7 wherein like parts are given the same reference characters as used in FIG. 7 with the rotary valve 73 being mounted on the cylinder block of engine 86 in the manner illustrated. It should be noted that this cylinder block is provided with a cooling chamber 87 for cooling the lower surface in the manner disclosed in FIG. 10 and for the same purposes.

Thus, in accordance with the object of the invention, a rotary valve has been disclosed for engine and compressor use which operates at a lower pressure than a poppet valve and on cylinder blocks similar to those utilizing poppet valves. The operating temperatures of the rotary valves are sufficiently reduced so as to provide long engine and compressor life.

While the principles of the invention have now been made clear in an illustration embodiment, there will be immediately obvious to those skilled in the art, many additional modifications of structure, arrangement, proportions, the elements, materials and parts used in the practice of the invention, and otherwise, which are particularly adapted for specific environments without departing from these principles. The appended claims are therefore intended to cover and embrace any such modifications, within the limits only of the true spirit and scope of the invention.

What is claimed is:

1. A pressure generating device comprising in combination:

a dome-shaped block, said block defining a cylinder having input and exhaust ports, a piston reciprocally mounted in said cylinder, at least one circular flat rotary valve having flat surfaces on opposite sides thereof and a port extending therethrough for controlling one of said input and exhaust ports, said rotary valve being mounted on said block for rotation on an outside surface thereof for controlling the associated port, said block defining a wear surface around the port against which said valve temporarily seats during each cycle of the pressure generating device, one of the flat surfaces of said valve being provided with a rack of gear teeth on that surface around its periphery at a point near its edge, a drive gear for meshing engagement with said rack of gear teeth, means for rotating said drive gear in a timed sequence for controlling the operation of said piston; and a cooling chamber formed in said block immediately below said outside surface of said block on which said valve rotates for cooling said valve, said cooling chamber extending over at least one-half of said outside surface of said block on which said valve rotates.

2. The pressure generating device set forth in claim 1 wherein:

one of said flat surfaces of said valve is provided with passageways formed therein for receiving a lubricant during its rotation for valve cooling purposes.

3. The pressure generating device set forth in claim 1 wherein:

said drive gear is in meshing engagement with each of the rotary valves for rotating the valves in a timed sequence for controlling the operation of said piston.

4. The pressure generating device set forth in claim 1 wherein:

said rack of teeth are formed to extend above said one of said surfaces of said valve.

* * * * *